US012492699B2

(12) United States Patent
Wada et al.

(10) Patent No.: US 12,492,699 B2
(45) Date of Patent: Dec. 9, 2025

(54) COMPRESSOR AND AIR CONDITIONER

(71) Applicant: DAIKIN INDUSTRIES, LTD., Osaka (JP)

(72) Inventors: Ryosuke Wada, Osaka (JP); Yuya Sunahara, Osaka (JP); Koichi Irikawa, Osaka (JP); Emu Kato, Osaka (JP); Haruka Hosogoe, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/918,936

(22) Filed: Oct. 17, 2024

(65) Prior Publication Data

US 2025/0043783 A1 Feb. 6, 2025

Related U.S. Application Data

(63) Continuation of application No. PCT/JP2023/014991, filed on Apr. 13, 2023.

(30) Foreign Application Priority Data

May 2, 2022 (JP) ..... 2022-075940

(51) Int. Cl.
*F04C 18/344* (2006.01)
*F04C 18/356* (2006.01)
(Continued)

(52) U.S. Cl.
CPC ..... *F04C 18/356* (2013.01); *F04C 18/3448* (2013.01); *F04C 29/04* (2013.01);
(Continued)

(58) Field of Classification Search
CPC .. F04C 18/3448; F04C 18/356; F04C 23/008; F04C 29/04; F04C 29/12; F04B 39/10–1066; F25B 31/02; F16K 15/08
See application file for complete search history.

(56) References Cited

U.S. PATENT DOCUMENTS 6,171,084 B1 * 1/2001 Wallis ..... F04C 29/126 418/270
9,404,499 B2 * 8/2016 Seibel ..... F04C 29/065
(Continued)

FOREIGN PATENT DOCUMENTS

WO 2017/221571 A1 12/2017
WO 2021/039080 A1 3/2021

OTHER PUBLICATIONS

CN103423163B—Masao et al.—Rotary Compressor And Ejection Refrigerating Circulation Device Comprises The Rotary Compressor—Dec. 12, 2017—English Machine Translation. (Year: 2017).*
(Continued)

*Primary Examiner* — Essama Omgba
(74) *Attorney, Agent, or Firm* — GLOBAL IP COUNSELORS, LLP

(57) ABSTRACT

A compressor includes a compression mechanism, an injection valve disposed in an injection passage, and an injection pipe to supply refrigerant to the injection passage. The injection valve includes a valve body movable along a first direction, a valve presser disposed closer to the injection pipe than the valve body to restrict movement of the valve body toward the injection pipe, and a valve seat disposed closer to a compression chamber than the valve body to restrict movement of the valve body toward the compression chamber. The valve presser has a first hole. The valve body has a second hole. A buffer space communicates with a first space that accommodates the valve body between the valve presser and the valve seat. An opening of the buffer space facing the valve body does not overlap an annular peripheral edge located around the second hole when viewed in the first direction.

15 Claims, 12 Drawing Sheets

(51) Int. Cl.

| | |
|---|---|
| ***F04C 29/04*** | (2006.01) |
| ***F04C 29/12*** | (2006.01) |
| ***F25B 31/02*** | (2006.01) |
| *F04C 23/00* | (2006.01) |

(52) U.S. Cl.
CPC ..... *F04C 29/12* (2013.01); *F25B 31/02* (2013.01); *F04C 23/008* (2013.01)

(56) References Cited

U.S. PATENT DOCUMENTS

| | | | | |
|---|---|---|---|---|
| 2015/0125330 | A1 | 5/2015 | Komura et al. | |
| 2017/0138361 | A1* | 5/2017 | Mizushima | F04C 29/042 |
| 2018/0238330 | A1 | 8/2018 | Tsuka | |
| 2019/0242385 | A1 | 8/2019 | Endou et al. | |
| 2019/0277292 | A1* | 9/2019 | Inada | F04C 29/042 |
| 2022/0178372 | A1 | 6/2022 | Inada et al. | |

OTHER PUBLICATIONS

WO2019171508A1—Ishibe—Rotary Compressor—Sep. 9, 2019—English Machine Translation. (Year: 2019).*
International Search Report of corresponding PCT Application No. PCT/JP2023/014991 dated Jun. 27, 2023.
International Preliminary Report of corresponding PCT Application No. PCT/JP2023/014991 dated Nov. 14, 2024.
Extended European Search Report received for EP Application No. 23799429.8, mailed on Jul. 10, 2025, 13 pages.

* cited by examiner

COMPRESSOR AND AIR CONDITIONER

CROSS-REFERENCE TO RELATED APPLICATIONS

This is a continuation of International Application No. PCT/JP2023/014991 filed on Apr. 13, 2023, which claims priority to Japanese Patent Application No. 2022-075940, filed on May 2, 2022. The entire disclosures of these applications are incorporated by reference herein.

BACKGROUND

Technical Field

The present disclosure relates to a compressor and an air conditioner.

Background Art

WO 2017/221571 A discloses a compressor including an injection mechanism that causes a refrigerant having an intermediate pressure to flow into a compression chamber. The injection mechanism includes a check valve that suppresses a flow of the refrigerant from the compression chamber to an injection passage. The check valve includes a valve element and a spring member. When the refrigerant in the compression chamber has a high pressure, the check valve regulates outflow of the refrigerant from the compression chamber to the injection passage. When the refrigerant in the compression chamber has a low pressure, the check valve allows inflow of the refrigerant having an intermediate pressure from the injection passage to the compression chamber.

SUMMARY

A compressor according to a first aspect includes a compression mechanism, an injection valve, and an injection pipe. The compression mechanism includes a compression chamber in which a refrigerant is compressed. The injection valve is disposed in an injection passage that communicates with the compression chamber. The injection pipe allows the refrigerant to be supplied to the injection passage.

The injection valve includes a valve body, a valve presser, and a valve seat. The valve body is disposed so as to be movable along a first direction. The valve presser is disposed closer to the injection pipe than the valve body, and restricts movement of the valve body toward the injection pipe. The valve seat is disposed closer to the compression chamber than the valve body, and restricts movement of the valve body toward the compression chamber. The valve presser has a first hole through which the refrigerant flowing out of the compression chamber passes. The valve body has a second hole through which the refrigerant passes.

The compressor has a buffer space that communicates with a first space, in which the valve body is accommodated between the valve presser and the valve seat, and into which the refrigerant flowing from the compression chamber into the first space flows.

DETAILED DESCRIPTION OF EMBODIMENT(S)

An air conditioner 1 including a compressor 21 according to one embodiment of the present disclosure will be described with reference to the drawings.

(1) Air Conditioner (1-1) Overall Configuration

Figure 1:
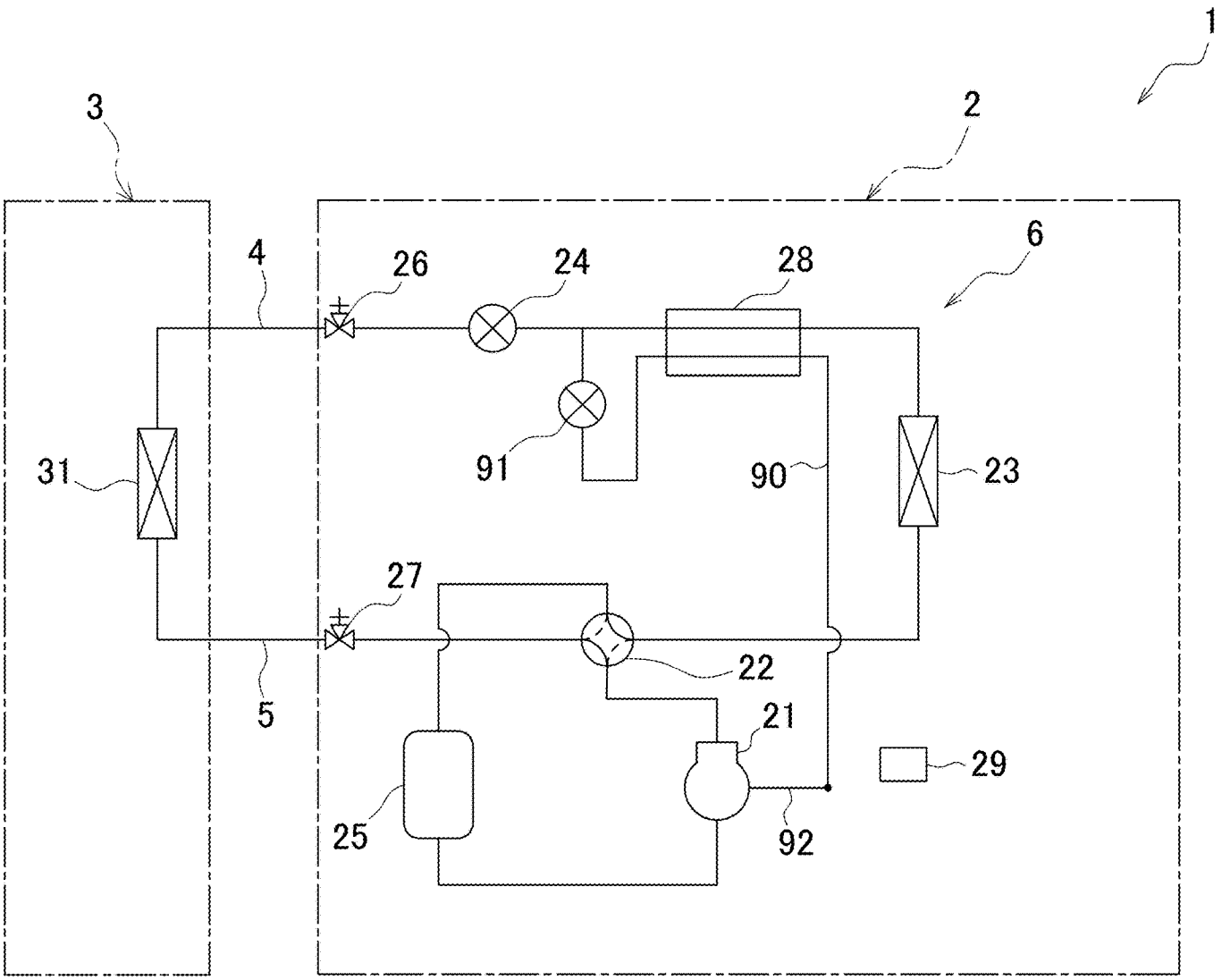
FIG. 1 is a schematic configuration diagram of an air conditioner 1 according to an embodiment.

As shown in FIG. 1, the air conditioner 1 is a device capable of performing cooling and heating of a room of a building or the like by performing a vapor compression refrigeration cycle. The air conditioner 1 mainly includes an outdoor unit 2, an indoor unit 3, a liquid-refrigerant connection pipe 4, and a gas-refrigerant connection pipe 5. The liquid-refrigerant connection pipe 4 and the gas-refrigerant connection pipe 5 connect the outdoor unit 2 and the indoor unit 3. The outdoor unit 2 and the indoor unit 3 are connected via the liquid-refrigerant connection pipe 4 and the gas-refrigerant connection pipe 5. This configures a vapor compression refrigerant circuit 6 of the air conditioner 1.

(1-2) Detailed Configuration (1-2-1) Indoor Unit

The indoor unit 3 is installed indoors (in a living room, a space above a ceiling, and the like) and constitute a part of the refrigerant circuit 6. The indoor unit 3 mainly includes an indoor heat exchanger 31. In a cooling operation, the indoor heat exchanger 31 functions as a heat absorber (evaporator) for the refrigerant to cool indoor air, and in a heating operation, the indoor heat exchanger 31 functions as a radiator (condenser) for the refrigerant to heat indoor air. A liquid side of the indoor heat exchanger 31 is connected to the liquid-refrigerant connection pipe 4. A gas side of the indoor heat exchanger 31 is connected to the gas-refrigerant connection pipe 5.

(1-2-2) Outdoor Unit

The outdoor unit 2 is installed outdoors (on a rooftop of a building, near a wall surface of a building, and the like) and constitutes a part of the refrigerant circuit 6. The outdoor unit 2 mainly includes a compressor 21, a four-way switching valve 22, an outdoor heat exchanger 23, an outdoor expansion valve 24, an accumulator 25, a liquid shutoff valve 26, a gas shutoff valve 27, an economizer heat exchanger 28, and a control unit 29.

The compressor 21 compresses a low-pressure gas refrigerant into a high-pressure gas refrigerant. The compressor 21 is driven by a compressor motor. The compressor 21 is a rotary compressor. In the compressor 21, intermediate injection is performed in which a part of the refrigerant having an intermediate pressure flowing from the outdoor heat exchanger 23 toward the outdoor expansion valve 24 is supplied to the compressor 21 compressing the refrigerant. The intermediate pressure is a predetermined pressure between a pressure (low pressure) of the gas refrigerant sucked into the compressor 21 and a pressure (high pressure) of the gas refrigerant discharged from the compressor 21.

The four-way switching valve 22 switches connection states of internal pipes of the outdoor unit 2. When the air conditioner 1 performs the cooling operation, the four-way switching valve 22 achieves the connection state indicated by the broken line in FIG. 1. When the air conditioner 1 performs the heating operation, the four-way switching valve 22 achieves the connection state indicated by the solid line in FIG. 1.

The outdoor heat exchanger 23 exchanges heat between the refrigerant circulating in the refrigerant circuit 6 and outdoor air. The outdoor heat exchanger 23 includes a refrigerant flow path through which the refrigerant flows, and a heat transfer fin in contact with the outdoor air. The outdoor heat exchanger 23 functions as a radiator (condenser) for the refrigerant during the cooling operation, and functions as a heat absorber (evaporator) for the refrigerant during the heating operation.

The outdoor expansion valve 24 is an electric valve or an electromagnetic valve having an adjustable opening degree. The outdoor expansion valve 24 decompresses the refrigerant flowing through the internal pipes of the outdoor unit 2. The outdoor expansion valve 24 controls a flow rate of the refrigerant flowing through the internal pipe of the outdoor unit 2.

The accumulator 25 is disposed in a pipe on a suction side of the compressor 21. The accumulator 25 separates a gas-liquid mixed refrigerant flowing in the refrigerant circuit 6 into a gas refrigerant and a liquid refrigerant and stores the liquid refrigerant. The gas refrigerant separated in the accumulator 25 is sent to a suction port of the compressor 21.

The liquid shutoff valve 26 and the gas shutoff valve 27 are valves capable of shutting off the refrigerant flow path. The liquid shutoff valve 26 is disposed between the indoor heat exchanger 31 and the outdoor expansion valve 24. The gas shutoff valve 27 is disposed between the indoor heat exchanger 31 and the four-way switching valve 22. The liquid shutoff valve 26 and the gas shutoff valve 27 are opened and closed by an operator, for example, when the air conditioner 1 is installed.

The economizer heat exchanger 28 is disposed between the outdoor heat exchanger 23 and the outdoor expansion valve 24. The economizer heat exchanger 28 exchanges heat between the refrigerant flowing from the outdoor heat exchanger 23 toward the outdoor expansion valve 24 and the refrigerant flowing through an economizer pipe 90. The economizer pipe 90 is a pipe branching from between the economizer heat exchanger 28 and the outdoor expansion valve 24 in the refrigerant circuit 6 and connected to an injection pipe 92 (described later). An economizer valve 91 is attached to the economizer pipe 90. The refrigerant flowing through the economizer pipe 90 is decompressed by the economizer valve 91, and then exchanges heat with the refrigerant flowing from the outdoor heat exchanger 23 toward the outdoor expansion valve 24 in the economizer heat exchanger 28. The refrigerant flowing from the outdoor heat exchanger 23 toward the outdoor expansion valve 24 and the refrigerant having exchanged heat in the economizer heat exchanger 28 are supplied to the injection pipe 92 as a refrigerant having an intermediate pressure.

The control unit 29 is a computer that controls components of the outdoor unit 2. The control unit 29 mainly includes a calculation device and a storage device. The calculation device is, for example, a CPU or a GPU. The calculation device reads a program stored in the storage device and performs predetermined calculation processing in accordance with the program. The calculation device writes a result of the calculation processing in the storage device and reads information stored in the storage device in accordance with the program.

(1-2-3) Connection Pipe

The liquid-refrigerant connection pipe 4 and the gas-refrigerant connection pipe 5 are refrigerant pipes constructed on site when the air conditioner 1 including the refrigerant circuit 6 is installed at an installation location such as a building. The lengths and pipe diameters of the liquid-refrigerant connection pipe 4 and the gas-refrigerant connection pipe 5 are determined in accordance with installation conditions such as an installation location of the air conditioner 1 and a combination of the outdoor unit 2 and the indoor unit 3. The refrigerant flowing through the liquid-refrigerant connection pipe 4 may be a liquid or alternatively a gas-liquid two-phase refrigerant.

(1-3) Operation of Air Conditioner

An operation of the air conditioner 1 during the cooling operation and the heating operation will be described with reference to FIG. 1.

(1-3-1) Heating Operation

In a case where the air conditioner 1 performs the heating operation, the four-way switching valve 22 is switched to a state indicated by the solid line in FIG. 1. In the refrigerant circuit 6, a low-pressure gas refrigerant of the refrigeration cycle is sucked into the compressor 21, and discharged after compressed to a high-pressure refrigerant of the refrigeration cycle. The high-pressure gas refrigerant discharged from the compressor 21 is sent to the indoor heat exchanger 31 via the four-way switching valve 22, the gas shutoff valve 27, and the gas-refrigerant connection pipe 5. The high-pressure gas refrigerant sent to the indoor heat exchanger 31 is condensed by heat exchange with indoor air in the indoor heat exchanger 31, and becomes a high-pressure liquid refrigerant. The indoor air is thus heated. The high-pressure liquid refrigerant that has been condensed in the indoor heat exchanger 31 is sent to the outdoor expansion valve 24 through the liquid-refrigerant connection pipe 4 and the liquid shutoff valve 26. The refrigerant sent to the outdoor expansion valve 24 is decompressed by the outdoor expansion valve 24 to low pressure in the refrigeration cycle. The low-pressure refrigerant decompressed in the outdoor expansion valve 24 is sent to the outdoor heat exchanger 23. The low-pressure refrigerant sent to the outdoor heat exchanger 23 is evaporated by heat exchange with outdoor air in the outdoor heat exchanger 23, and becomes a low-pressure gas refrigerant. The low-pressure refrigerant that has been evaporated in the outdoor heat exchanger 23 is sucked again into the compressor 21 via the four-way switching valve 22 and the accumulator 25.

(1-3-2) Cooling Operation

In a case where the air conditioner 1 performs the cooling operation, the four-way switching valve 22 is switched to a state indicated by the broken line in FIG. 1. In the refrigerant circuit 6, a low-pressure gas refrigerant of the refrigeration cycle is sucked into the compressor 21, and discharged after compressed to a high-pressure refrigerant of the refrigeration cycle. The high-pressure gas refrigerant discharged from the compressor 21 is sent to the outdoor heat exchanger 23 through the four-way switching valve 22. The high-pressure gas refrigerant sent to the outdoor heat exchanger 23 is condensed by heat exchange with outdoor air in the outdoor heat exchanger 23, and becomes a high-pressure liquid refrigerant. The liquid refrigerant that has been condensed in the outdoor heat exchanger 23 is decompressed by the outdoor expansion valve 24 to low pressure in the refrigeration cycle. The low-pressure refrigerant decompressed in the outdoor expansion valve 24 is sent to the indoor heat exchanger 31 through the liquid shutoff valve 26 and the liquid-refrigerant connection pipe 4. The refrigerant sent to the indoor heat exchanger 31 is evaporated by heat exchange with indoor air in the indoor heat exchanger 31, and becomes a low-pressure gas refrigerant. The indoor air is thus cooled. The gas refrigerant that has been evaporated in the indoor heat exchanger 31 is sucked again into the compressor 21 via the gas-refrigerant connection pipe 5, the gas shutoff valve 27, the four-way switching valve 22, and the accumulator 25.

(2) Compressor (2-1) Overall Configuration

Figure 2:
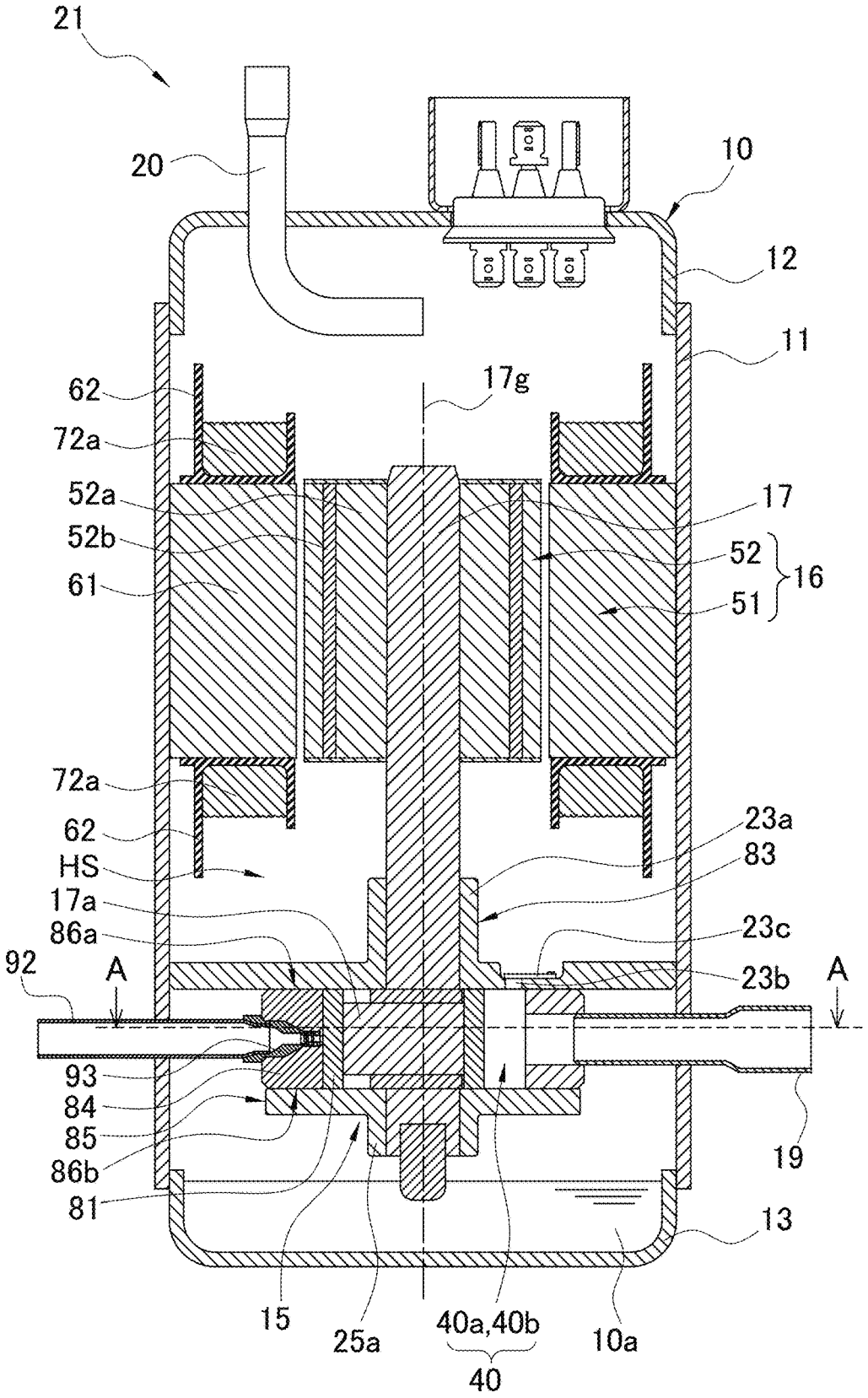
FIG. 2 is a longitudinal sectional view of a compressor 21.

As shown in FIG. 2, the compressor 21 mainly includes a casing 10, a compression mechanism 15, a drive motor 16, a crankshaft 17, a suction pipe 19, a discharge pipe 20, an injection pipe 92, and an injection valve 93.

(2-1-1) Casing

The casing 10 includes a cylindrical trunk 11, a bowl-shaped top 12, and a bowl-shaped bottom 13. The top 12 is airtightly connected to an upper end of the trunk 11. The bottom 13 is airtightly connected to a lower end of the trunk 11.

The casing 10 is formed with a rigid member that is less likely to be deformed and damaged due to changes in pressure and temperature in an internal space and an external space of the casing 10. The casing 10 is disposed with an axial direction of the cylindrical shape of the trunk 11 along a vertical direction. The casing 10 has an internal space including a lower part serving as an oil reservoir 10*a* that stores lubricating oil. The lubricating oil is refrigerator oil used to improve lubricity of a slider inside the casing 10.

The casing 10 mainly accommodates the compression mechanism 15, the drive motor 16, and the crankshaft 17. The compression mechanism 15 is coupled to the drive motor 16 via the crankshaft 17. The suction pipe 19, the discharge pipe 20, and the injection pipe 92 are airtightly coupled to the casing 10 so as to penetrate the casing 10.

(2-1-2) Compression Mechanism

Figure 3:
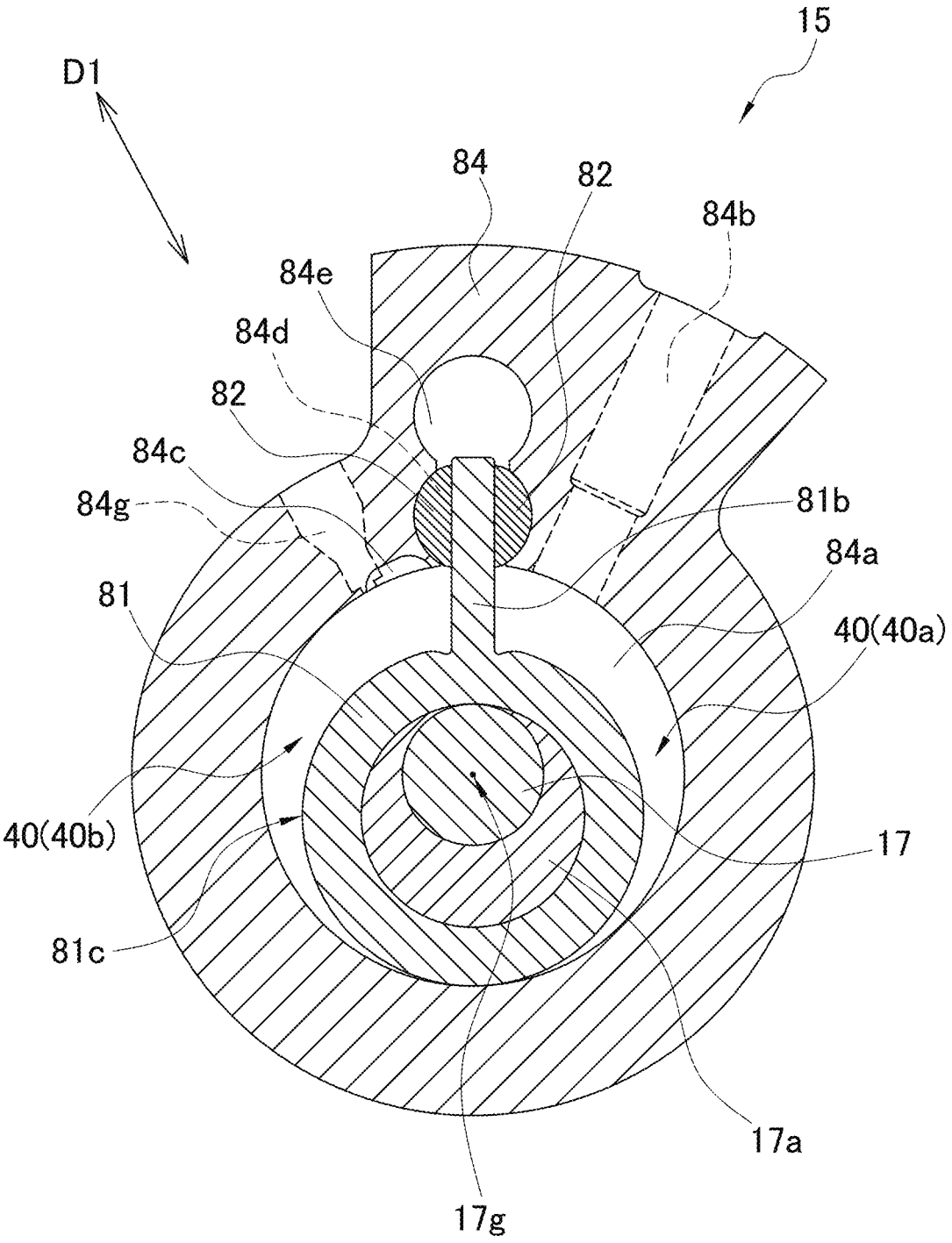
FIG. 3 is a sectional view of a compression mechanism 15 taken along line A-A in FIG. 2.

As shown in FIGS. 2 and 3, the compression mechanism 15 mainly includes a front head 83, a cylinder 84, a rear head 85, a piston 81, and a bush 82. The front head 83, the cylinder 84, and the rear head 85 are integrally fastened by bolts or the like. A space above the compression mechanism 15 is a high-pressure space HS from which the refrigerant compressed by the compression mechanism 15 is discharged.

The compression mechanism 15 is immersed in the lubricating oil stored in the oil reservoir 10*a*. The lubricating oil in the oil reservoir 10*a* is supplied to the slider inside the compression mechanism 15 by differential pressure or the like. Next, constituent elements of the compression mechanism 15 will be described.

(2-1-2-1) Cylinder

Figure 4:
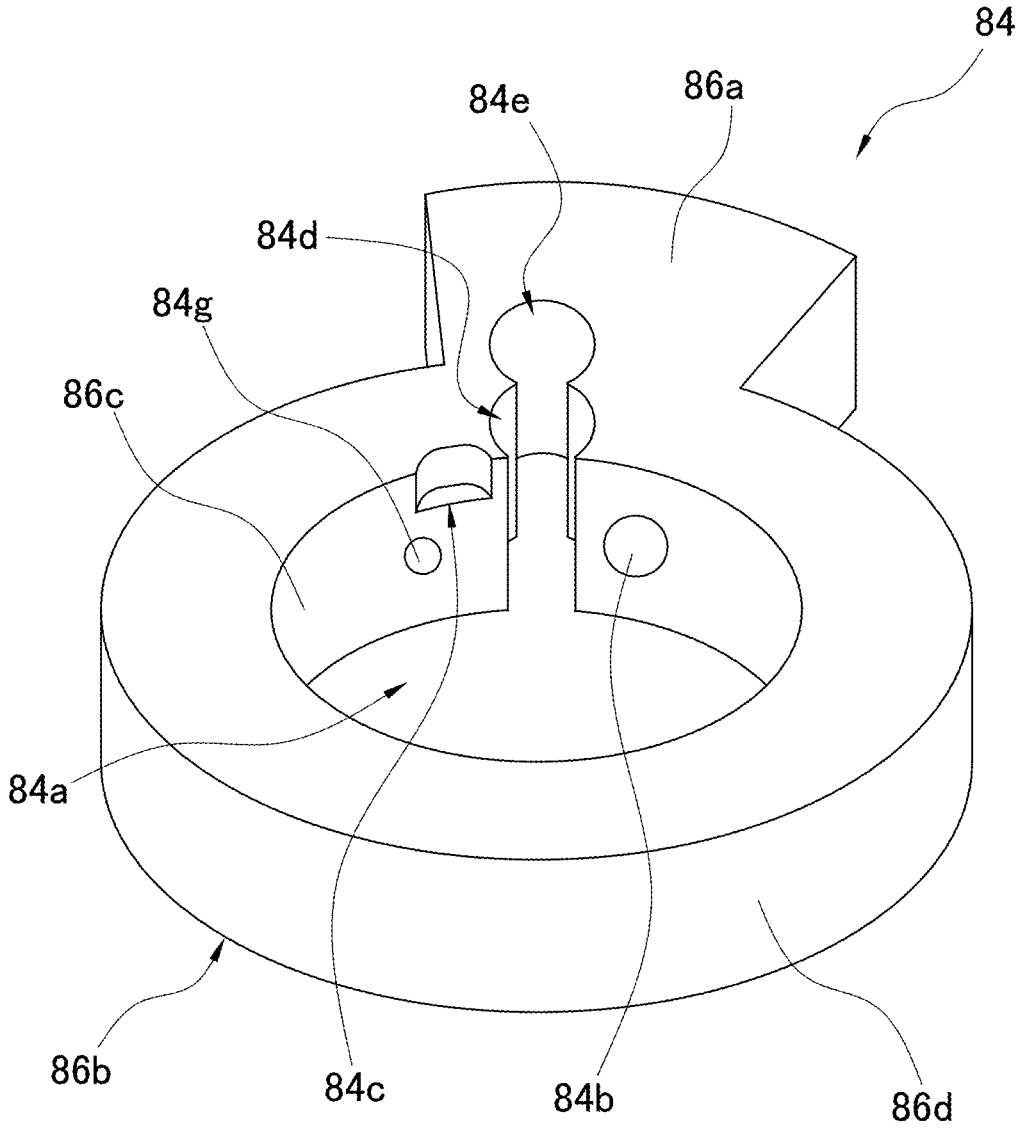
FIG. 4 is an external view of a cylinder 84.

As shown in FIG. 4, the cylinder 84 mainly includes a cylinder hole 84*a*, a suction hole 84*b*, a discharge cutout 84*c*, a bush accommodation hole 84*d*, a vane accommodation hole 84*e*, and an injection passage 84*g*. The cylinder 84 is located between the front head 83 and the rear head 85. A first cylinder end surface 86*a*, which is an upper end surface of the cylinder 84, is in contact with a lower surface of the front head 83. A second cylinder end surface 86*b*, which is a lower end surface of the cylinder 84, is in contact with an upper surface of the rear head 85.

The cylinder hole 84*a* is a columnar hole that penetrates the cylinder 84 in the vertical direction from the first cylinder end surface 86*a* toward the second cylinder end surface 86*b*. The cylinder hole 84*a* is a space surrounded by a cylinder inner peripheral surface 86*c* which is an inner peripheral surface of the cylinder 84. The cylinder hole 84*a* accommodates the eccentric shaft 17*a* of the crankshaft 17 and the piston 81.

The suction hole 84*b* is a hole that penetrates along a radial direction of the cylinder 84 from a cylinder outer peripheral surface 86*d*, which is an outer peripheral surface of the cylinder 84, toward the cylinder inner peripheral surface 86*c*.

The discharge cutout 84*c* is a space formed by cutting out a part of the cylinder inner peripheral surface 86*c* without penetrating the cylinder 84 in the vertical direction. The discharge cutout 84*c* is formed on the side of the first cylinder end surface 86*a*.

The bush accommodation hole 84*d* is a hole that penetrates the cylinder 84 in the vertical direction and is disposed between the suction hole 84*b* and the discharge cutout 84*c* when the cylinder 84 is viewed in the vertical direction. The bush accommodation hole 84*d* accommodates a part of a vane 81*b* and the bush 82.

The vane accommodation hole 84*e* is a hole that penetrates the cylinder 84 in the vertical direction and communicates with the bush accommodation hole 84*d*. The vane accommodation hole 84*e* accommodates a part of the vane 81*b*.

The injection passage 84*g* is a hole that penetrates along the radial direction of the cylinder 84 from the cylinder outer peripheral surface 86*d* toward the cylinder inner peripheral surface 86*c*. As shown in FIG. 3, when the cylinder 84 is viewed in the vertical direction, the bush accommodation hole 84*d* is disposed between the suction hole 84*b* and the injection passage 84*g*. The injection valve 93 is disposed in the injection passage 84*g*. The injection passage 84*g* communicates with the injection pipe 92 on the side of the cylinder outer peripheral surface 86*d*, and communicates with the compression chamber 40 on the side of the cylinder inner peripheral surface 86*c*.

(2-1-2-2) Piston

The piston 81 is a substantially cylindrical member to be inserted into the cylinder hole 84*a* of the cylinder 84. An upper end surface of the piston 81 is in contact with the lower surface of the front head 83. A lower end surface of the piston 81 is in contact with the upper surface of the rear head 85.

The piston 81 is inserted into the cylinder hole 84*a* of the cylinder 84 in a state of being fitted into the eccentric shaft 17*a* of the crankshaft 17. As a result, the piston 81 eccentrically rotates by an axial rotation of the crankshaft 17, and performs an orbital motion about an axis 17*g* of the crankshaft 17. The piston 81 revolves clockwise in top view of the compression mechanism 15.

The vane 81*b* is accommodated in the bush accommodation hole 84*d* and the vane accommodation hole 84*e* of the cylinder 84. The vane 81*b* is formed integrally with the piston 81. The vane 81*b* extends along a radial direction of the piston 81 so as to protrude radially outward of the piston 81. When the piston 81 revolves, the vane 81*b* moves forward and backward along a longitudinal direction of the vane 81*b* while swinging. At this time, the bush 82 supports the vane 81*b* while rotating in the bush accommodation hole 84*d*.

The compression mechanism 15 includes a compression chamber 40 that is a space surrounded by the cylinder 84, the piston 81, the vane 81*b*, the front head 83, and the rear head 85. The compression chamber 40 is a part of the cylinder hole 84*a*, and is a space in which the refrigerant is compressed when the volume changes with the revolution of the piston 81. The lubricating oil in the oil reservoir 10*a* is supplied to the compression chamber 40.

The compression chamber 40 is defined by the piston 81 and the vane 81*b* into a low-pressure chamber 40*a* communicating with the suction hole 84*b* and a high-pressure chamber 40*b* communicating with the discharge cutout 84*c* and the injection passage 84*g*. In FIG. 3, the low-pressure chamber 40*a* and the high-pressure chamber 40*b* are regions surrounded by the cylinder inner peripheral surface 86*c* and a piston outer peripheral surface 81*c* that is an outer peripheral surface of the piston 81. The volumes of the low-pressure chamber 40*a* and the high-pressure chamber 40*b* change in accordance with the position of the piston 81.

(2-1-2-3) Bush

The bush 82 includes a pair of substantially semi-cylindrical members. The bush 82 is accommodated in the bush accommodation hole 84*d* of the cylinder 84 so as to sandwich the vane 81*b*. The bush 82 is slidable with the cylinder 84.

(2-1-2-4) Front Head

The front head 83 is a member that covers the first cylinder end surface 86*a* of the cylinder 84. The front head 83 is fastened to the casing 10 with a bolt or the like. The front head 83 includes an upper bearing 23*a* for supporting the crankshaft 17.

The front head 83 includes a discharge port 23*b*. The discharge port 23*b* is a cylindrical hole that penetrates the front head 83 in the vertical direction. The discharge port 23*b* communicates with the discharge cutout 84*c* and the compression chamber 40 (high-pressure chamber 40*b*) on a lower side in the vertical direction. The discharge port 23*b* communicates with the high-pressure space HS on an upper side in the vertical direction. The discharge port 23*b* is a flow path for sending the refrigerant compressed by the compression mechanism 15 from the high-pressure chamber 40*b* to the high-pressure space HS.

A discharge valve 23*c* that closes the discharge port 23*b* is attached to an upper surface of the front head 83. The discharge valve 23*c* is a valve for preventing backflow of the refrigerant from the high-pressure space HS to the high-pressure chamber 40*b*. The discharge valve 23*c* is lifted upward by the pressure of the refrigerant inside the discharge port 23*b*. As a result, the discharge port 23*b* opens, and the discharge port 23*b* communicates with the high-pressure space HS.

(2-1-2-5) Rear Head

The rear head 85 is a member that covers the second cylinder end surface 86*b* of the cylinder 84. The rear head 85 has a lower bearing 25*a* for supporting the crankshaft 17. The cylinder hole 84*a* of the cylinder 84 is closed by the front head 83 and the rear head 85.

(2-1-3) Drive Motor

The drive motor 16 is a brushless DC motor accommodated in the casing 10 and disposed above the compression mechanism 15. The drive motor 16 mainly includes a stator 51 fixed to an inner wall surface of the casing 10 and a rotor 52 rotatably accommodated on an inner side of the stator 51. The stator 51 and the rotor 52 have an air gap therebetween.

The stator 51 includes a stator core 61 and a pair of insulators 62 attached to both end surfaces of the stator core 61 in the vertical direction. The stator core 61 includes a cylindrical portion and a plurality of teeth (not shown) protruding radially inward from an inner peripheral surface of the cylindrical portion. A conductive wire is wound around the teeth of the stator core 61 together with the pair of insulators 62. As a result, a coil 72*a* is formed in each tooth of the stator core 61.

On an outer side surface of the stator 51, a plurality of core cut portions (not shown) formed by cutting are provided from an upper end surface to a lower end surface of the stator 51 and at predetermined intervals in a circumferential direction. The core cut portion forms a motor cooling passage extending in the vertical direction between the trunk 11 and the stator 51.

The rotor 52 has a rotor core 52*a* including a plurality of metal plates stacked in the vertical direction and a plurality of magnets 52*b* embedded in the rotor core 52*a*. The magnets 52*b* are arranged at equal intervals along a circumferential direction of the rotor core 52*a*. The rotor 52 has a rotation center coupled to the crankshaft 17 penetrating in the vertical direction. The rotor 52 is connected to the compression mechanism 15 via the crankshaft 17.

(2-1-4) Crankshaft

The crankshaft 17 is accommodated in the casing 10 and is disposed with an axial direction of the crankshaft 17 along the vertical direction. The crankshaft 17 is coupled to the rotor 52 of the drive motor 16 and the piston 81 of the compression mechanism 15. The crankshaft 17 includes the eccentric shaft 17*a*. The eccentric shaft 17*a* is coupled to the piston 81 inserted into the cylinder hole 84*a* of the cylinder 84. An upper end of the crankshaft 17 is coupled to the rotor 52 of the drive motor 16. The crankshaft 17 is supported by the upper bearing 23*a* of the front head 83 and a lower bearing 25*a* of the rear head 85. The crankshaft 17 rotates about the axis 17*g*.

(2-1-5) Suction Pipe

The suction pipe 19 is a pipe that penetrates the trunk 11 of the casing 10. An end of the suction pipe 19 inside of the casing 10 is fitted into the suction hole 84*b* of the cylinder 84. An end of the suction pipe 19 outside the casing 10 is connected to the refrigerant circuit 6. The suction pipe 19 allows the refrigerant to be supplied from the refrigerant circuit 6 to the compression mechanism 15.

(2-1-6) Discharge Pipe

The discharge pipe 20 is a pipe that penetrates the top 12 of the casing 10. An end of the discharge pipe 20 inside the casing 10 is located in a space above the drive motor 16. An end of the discharge pipe 20 outside the casing 10 is connected to the refrigerant circuit 6. The discharge pipe 20 allows the refrigerant compressed by the compression mechanism 15 to be supplied to the refrigerant circuit 6.

(2-1-7) Injection Pipe

The injection pipe 92 is a pipe that penetrates the trunk 11 of the casing 10. An end of the injection pipe 92 inside the casing 10 is connected to the injection valve 93 disposed in the injection passage 84*g* of the cylinder 84. An end of the injection pipe 92 outside the casing 10 is connected to the economizer pipe 90. The injection pipe 92 allows the refrigerant in the economizer pipe 90 to be supplied to the injection passage 84*g*.

(2-1-8) Injection Valve

Figure 5:
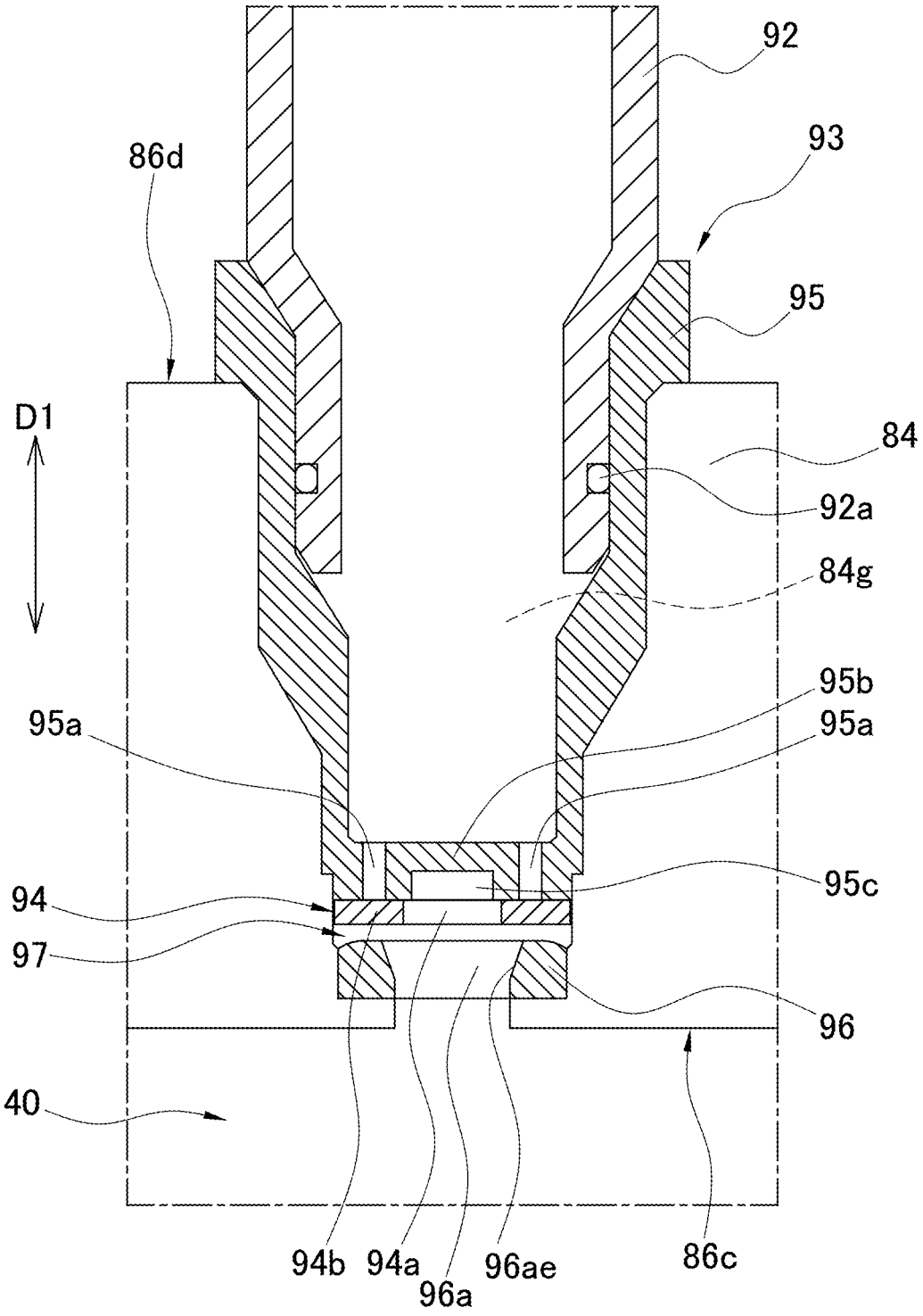
FIG. 5 is a sectional view showing a configuration of an injection valve 93 in a first state.
Figure 6:
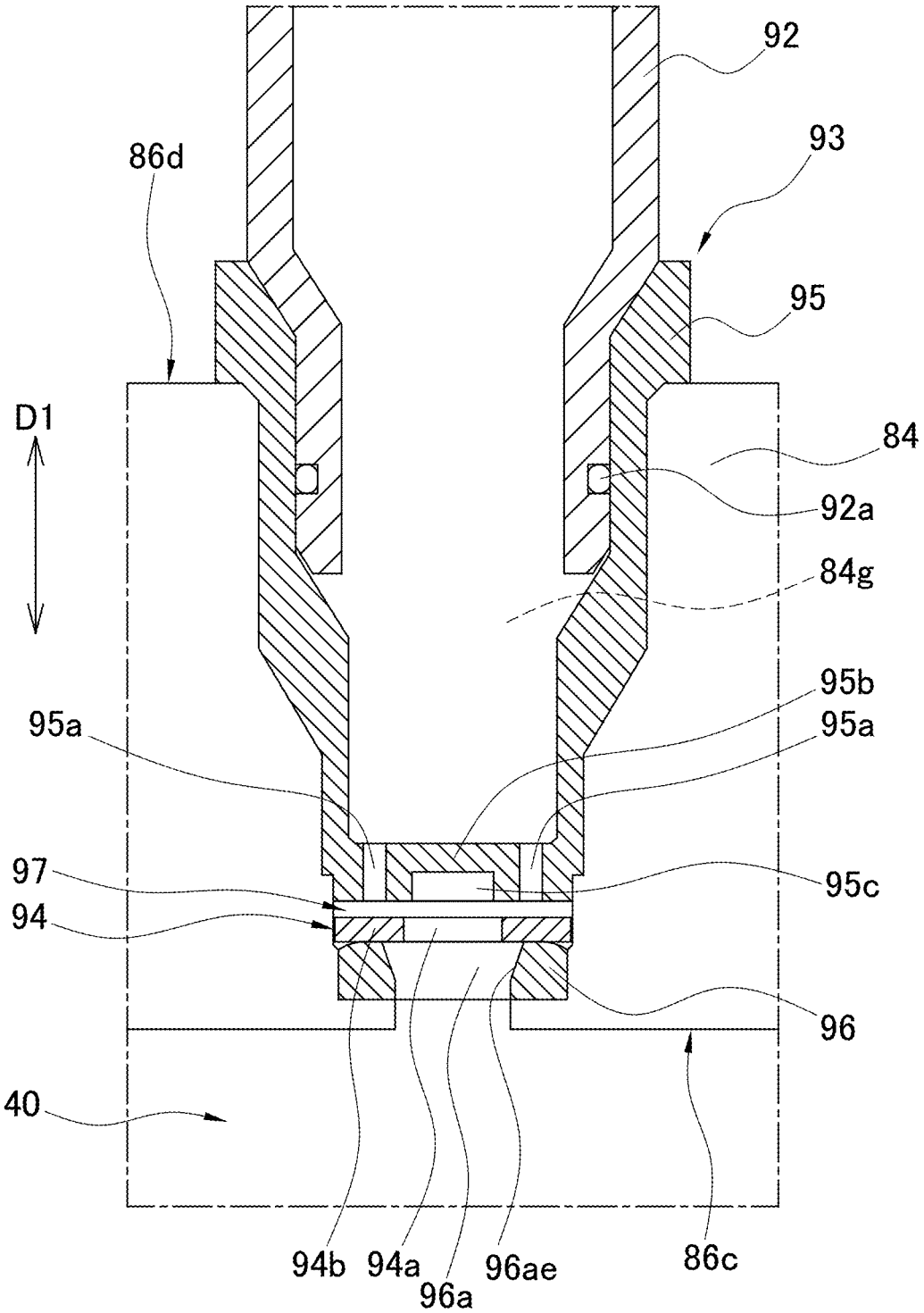
FIG. 6 is a sectional view showing a configuration of the injection valve 93 in a second state.

The injection valve 93 performs intermediate injection and prevents a reverse flow of the refrigerant from the compression chamber 40 to the injection passage 84*g*. As shown in FIGS. 5 and 6, the injection valve 93 mainly includes a valve body 94, a valve presser 95, and a valve seat 96. The valve presser 95 and the valve seat 96 are fixed to the cylinder 84 by being press-fitted into the injection passage 84*g*. The valve presser 95 and the valve seat 96 are disposed to be separated from each other along a first direction D1 in which the injection passage 84*g* extends. The space between the valve presser 95 and the valve seat 96 is a first space 97 in which the valve body 94 is accommodated so as to be movable along the first direction D1. The first space 97 is a cylindrical space. The valve presser 95 is disposed closer to the injection pipe 92 than the valve body 94. The valve seat 96 is disposed closer to the compression chamber 40 than the valve body 94.

The injection passage 84*g* is a circular hole having different inner diameters along the first direction D1. The injection passage 84*g* has the largest inner diameter at an end closer to the cylinder outer peripheral surface 86*d*, and has the smallest inner diameter at an end closer to the cylinder inner peripheral surface 86*c*. Specifically, the inner diameter of the injection passage 84*g* increases from the cylinder inner peripheral surface 86*c* toward the cylinder outer peripheral surface 86*d*.

Figure 8:
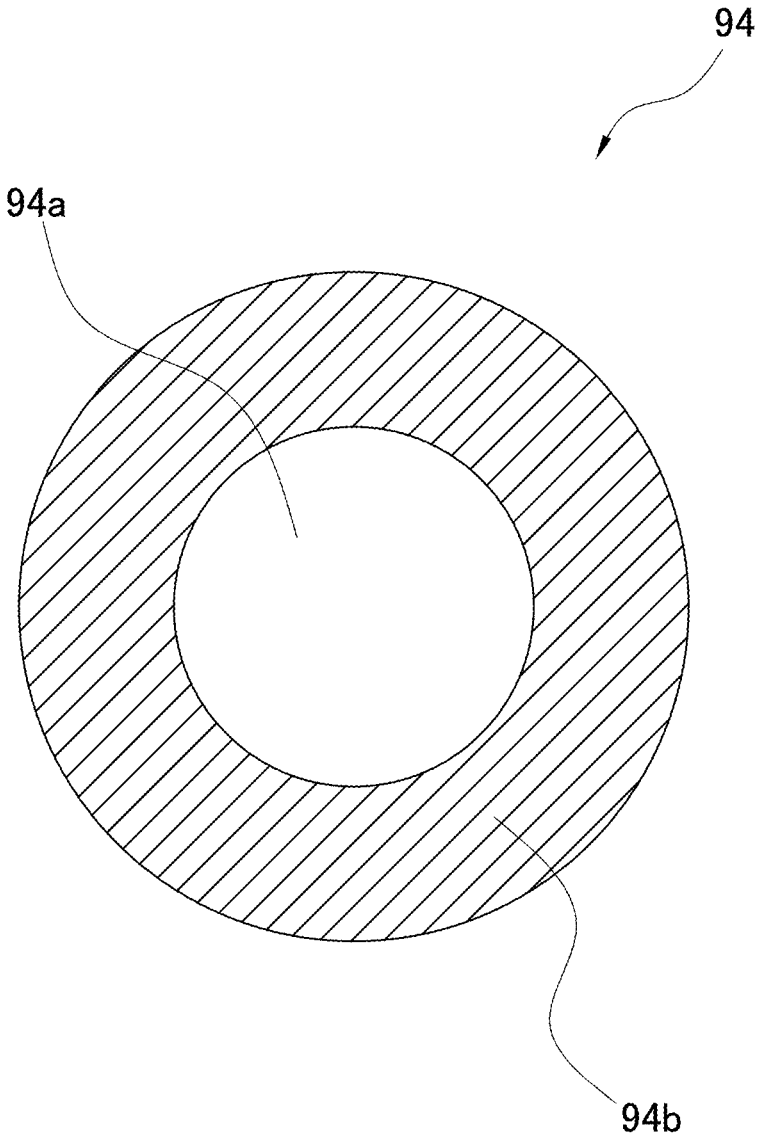
FIG. 8 is a plan view of a valve body 94 when viewed in a first direction D1.

The valve body 94 is a circular flat plate. The valve body 94 is formed with spring steel such as GIN6 (stainless steel hardened by Hitachi Metals, Ltd.). As shown in FIG. 8, a circular second hole 94*a* is formed at a center of the valve body 94. The valve body 94 has an annular peripheral edge 94*b* located around the second hole 94*a*. In FIG. 8, the peripheral edge 94*b* is indicated as a hatched region. The valve body 94 is disposed in the first space 97 so as to be movable along the first direction D1.

The valve presser 95 is press-fitted on the side of the cylinder outer peripheral surface 86*d* of the injection passage 84*g*. The valve presser 95 have different outer diameters along the first direction D1. A part of the valve presser 95 protrudes outward from the cylinder outer peripheral surface 86*d*. The injection pipe 92 is inserted into the valve presser 95 from the side of the cylinder outer peripheral surface 86*d*. The injection pipe 92 is fixed to the valve presser 95. As shown in FIGS. 5 and 6, an O ring 92*a* attached to the injection pipe 92 separates the injection passage 84*g* and the high-pressure space HS. The valve presser 95 has a first hole 95*a*, a closing portion 95*b*, and a buffer space 95*c*.

Figure 9:
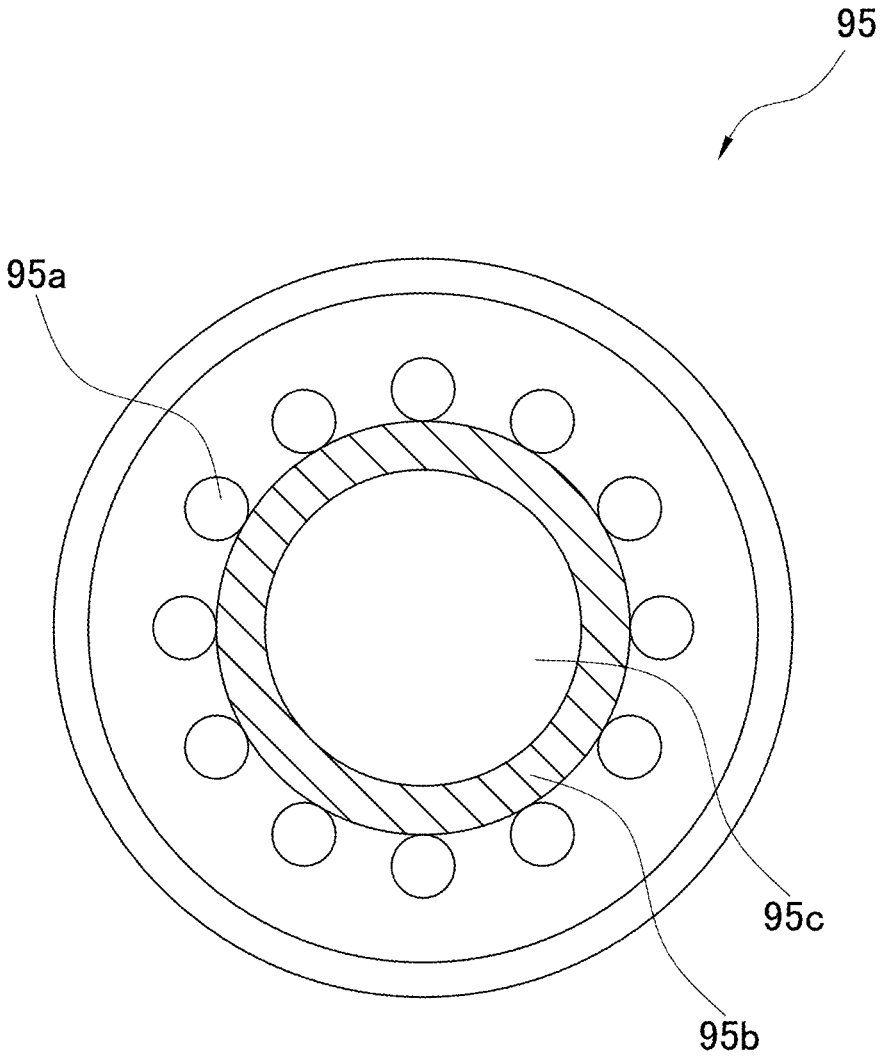
FIG. 9 is a plan view of a valve presser 95 when viewed in the first direction D1 from a cylinder inner peripheral surface 86*c*.

The first hole 95*a* is a hole through which the refrigerant passes, and is closed by the valve body 94 when the refrigerant flows out of the compression chamber 40. The first hole 95*a* penetrates the valve presser 95 along the first direction D1. As shown in FIG. 9, the closing portion 95*b* is an annular region located at a center of the valve presser 95 when the valve presser 95 is viewed in the first direction D1 from the cylinder inner peripheral surface 86*c*. The plurality of first holes 95*a* is formed around the closing portion 95*b*. The buffer space 95*c* is formed such that the center of the buffer space 95*c* overlaps a center of the closing portion 95*b* along the first direction D1. In FIG. 9, the closing portion 95*b* is indicated as a hatched region. In the valve presser 95 shown in FIG. 9, 12 first holes 95*a* are arranged in a circular shape. An outer diameter of the closing portion 95*b* is larger than a diameter of the second hole 94*a* of the valve body 94. The diameter of the first hole 95*a* is smaller than a width of the peripheral edge 94*b* of the valve body 94 (dimension in a radial direction of the valve body 94).

Figure 7:
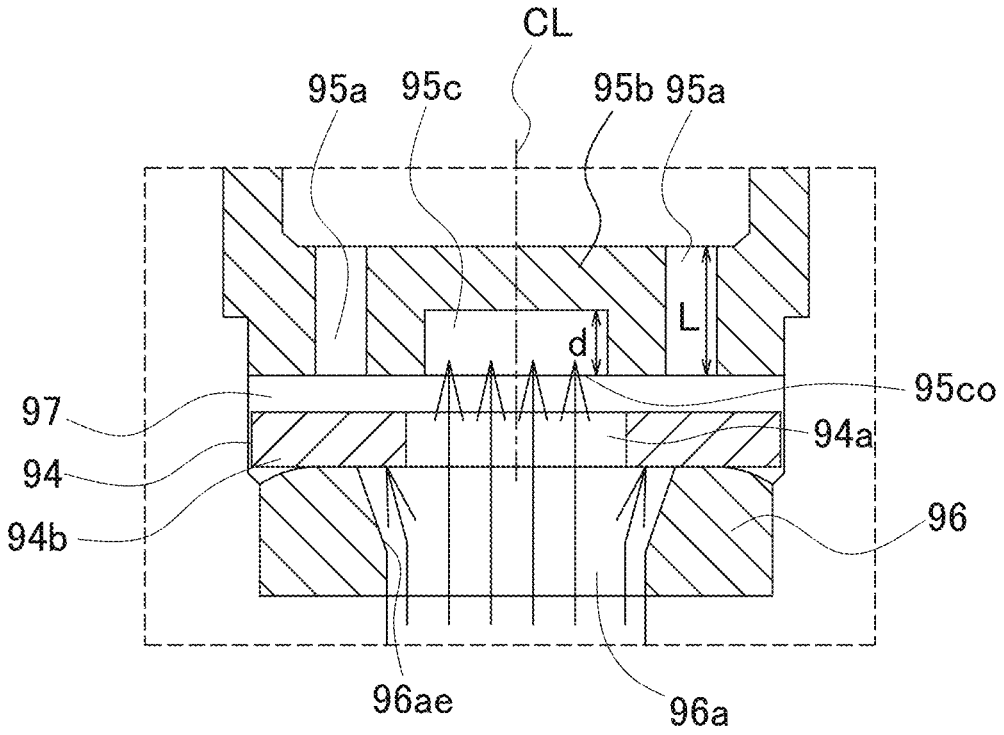
FIG. 7 is an enlarged sectional view of a periphery of a first space 97 in the second state.

The buffer space 95*c* is a space formed in communication with the first space 97 such that the refrigerant flowing into the first space 97 from the compression chamber 40 flows in before reaching the first hole 95*a*. The buffer space 95*c* is formed closer to the injection pipe 92 than the second hole 94*a*. In the present embodiment, the buffer space 95*c* is a columnar concave portion formed on a surface of the closing portion 95*b* facing the valve body 94. The buffer space 95*c* is formed so as to be located on a center axis CL of the first space 97 together with the second hole 94*a* (see FIG. 7).

In the present embodiment, the buffer space 95*c* is formed such that an area of a circular opening 95*co* facing the valve body 94 is smaller than a flow path area of the second hole 94*a*. A ratio of the area of the opening 95*co* of the buffer space 95*c* facing the valve body 94 to the flow path area of the second hole 94*a* is preferably 0.5 or more and 1.0 or less. The opening 95*co* is preferably formed so as to be entirely exposed to the cylinder inner peripheral surface 86*c* through the second hole 94*a*. In other words, the opening 95*co* is preferably formed so as not to generate a region overlapping the peripheral edge 94*b* when viewed from the cylinder inner peripheral surface 86*c* along the first direction D1.

A ratio of a depth d (see FIG. 7) of the buffer space 95*c* in the first direction D1 of the first space 97 to a length L of the first hole 95*a* in the first direction D1 is preferably 0.3 or more and 0.6 or less. A ratio of a volume of the buffer space 95*c* to a total volume of the first space 97 and a third hole 96*a* (described later) formed in the valve seat 96 is preferably 0.2 or more and 0.8 or less.

The valve presser 95 restricts movement of the valve body 94 toward the injection pipe 92. In other words, when moving in the first direction D1 toward the injection pipe 92, the valve body 94 is movable until hitting the valve presser 95. In a state where the valve body 94 is in contact with the valve presser 95, the first hole 95*a* of the valve presser 95 is closed by the peripheral edge 94*b* of the valve body 94. At this time, the second hole 94*a* of the valve body 94 is closed by the closing portion 95*b* of the valve presser 95. In a state where the valve body 94 is separated from the valve presser 95, the first hole 95*a* of the valve presser 95 is not closed by the peripheral edge 94*b* of the valve body 94. At this time, the second hole 94*a* of the valve body 94 is not closed by the closing portion 95*b* of the valve presser 95.

In this manner, the first hole 95*a* of the valve presser 95 is opened and closed by the valve body 94. Specifically, in a state where the valve body 94 is in contact with the valve presser 95, the second hole 94*a* of the valve body 94 and the first hole 95*a* of the valve presser 95 are closed, and thus, the injection valve 93 is closed (see FIG. 5). Therefore, the refrigerant in the injection pipe 92 cannot flow into the compression chamber 40 through the first hole 95*a* and the second hole 94*a*. On the other hand, in a state where the valve body 94 is separated from the valve presser 95, the second hole 94*a* of the valve body 94 and the first hole 95*a* of the valve presser 95 are not closed, and thus, the injection valve 93 is opened (see FIG. 6). Therefore, the refrigerant in the injection pipe 92 can flow into the compression chamber 40 through the first hole 95*a* and the second hole 94*a*.

The valve seat 96 restricts movement of the valve body 94 toward the compression chamber 40. The valve seat 96 is press-fitted on the side of the cylinder inner peripheral surface 86*c* of the injection passage 84*g*. The valve seat 96 has a cylindrical shape whose outer diameter is substantially constant along the first direction D1. The valve seat 96 has the third hole 96*a*. The third hole 96*a* penetrates the valve seat 96 along the first direction D1. The valve seat 96 allows the first space 97 and the compression chamber 40 to communicate with each other. The third hole 96*a* includes an enlarged portion 96*ae* having an inner diameter enlarged from the compression chamber 40 to an opening closer to the injection pipe 92. The smallest inner diameter of the third hole 96*a* is substantially the same as an inner diameter of the second hole 94*a* of the valve body 94. The inner diameter of the opening of the enlarged portion 96*ae*, which is the largest inner diameter of the third hole 96*a*, is larger than the inner diameter of the second hole 94*a* of the valve body 94. The third hole 96*a* always communicates with the compression chamber 40 via the injection passage 84*g*.

When moving in the first direction D1 toward the compression chamber 40, the valve body 94 is movable until hitting the valve seat 96. In a state where the valve body 94 is in contact with the valve seat 96, the second hole 94*a* of the valve body 94 communicates with the third hole 96*a* of the valve seat 96. When the valve body 94 is in contact with the valve seat 96, since the valve body 94 is separated from the valve presser 95, the injection valve 93 is opened (see FIG. 6).

(2-2) Operation of Compressor

When the drive motor 16 is started, the eccentric shaft 17*a* of the crankshaft 17 eccentrically rotates about the axis 17*g* of the crankshaft 17. As a result, the piston 81 coupled to the eccentric shaft 17*a* revolves in the cylinder hole 84*a* of the cylinder 84. While the piston 81 is revolving, the piston outer peripheral surface 81*c* is in contact with the cylinder inner peripheral surface 86*c*. The revolution of the piston 81 causes the vane 81*b* to move forward and backward while both side surfaces of the vane 81*b* are sandwiched by the bush 82.

As the piston 81 revolves, the compression chamber 40 (low-pressure chamber 40*a*) communicating with the suction hole 84*b* gradually increases in volume. At this time, the low-pressure refrigerant flows from outside the casing 10 into the low-pressure chamber 40*a* via the suction pipe 19. As the piston 81 revolves, the low-pressure chamber 40*a* becomes the high-pressure chamber 40*b* communicating with the discharge cutout 84*c*, the high-pressure chamber 40*b* gradually decreases in volume and disappears, and then a new low-pressure chamber 40*a* is formed. As a result, the low-pressure refrigerant flowing from the suction pipe 19 into the low-pressure chamber 40*a* via the suction hole 84*b* is compressed in the compression chamber 40 (high-pressure chamber 40*b*). While the refrigerant is compressed in the compression chamber 40, the vane 81*b* is held between the pair of bushes so as to be movable forward and backward.

The high-pressure refrigerant compressed in the high-pressure chamber 40*b* is discharged into the high-pressure space HS via the discharge cutout 84*c* and the discharge port 23*b*. The refrigerant discharged into the high-pressure space HS flows upward through the motor cooling passage of the drive motor 16, and then is discharged from the discharge pipe 20 to the outside of the casing 10.

(2-3) Intermediate Injection

The intermediate injection is performed when the refrigerant having an intermediate pressure is supplied from the injection passage 84*g* to the high-pressure chamber 40*b* in a state where the injection valve 93 is opened. The intermediate injection is performed when the pressure in the compression chamber 40 (high-pressure chamber 40*b*) is lower than the intermediate pressure, and is not performed when the pressure in the compression chamber 40 (high-pressure chamber 40*b*) is equal to or higher than the intermediate pressure.

While the piston 81 is revolving, the injection valve 93 repeats opening and closing as described below.

Figure 10:
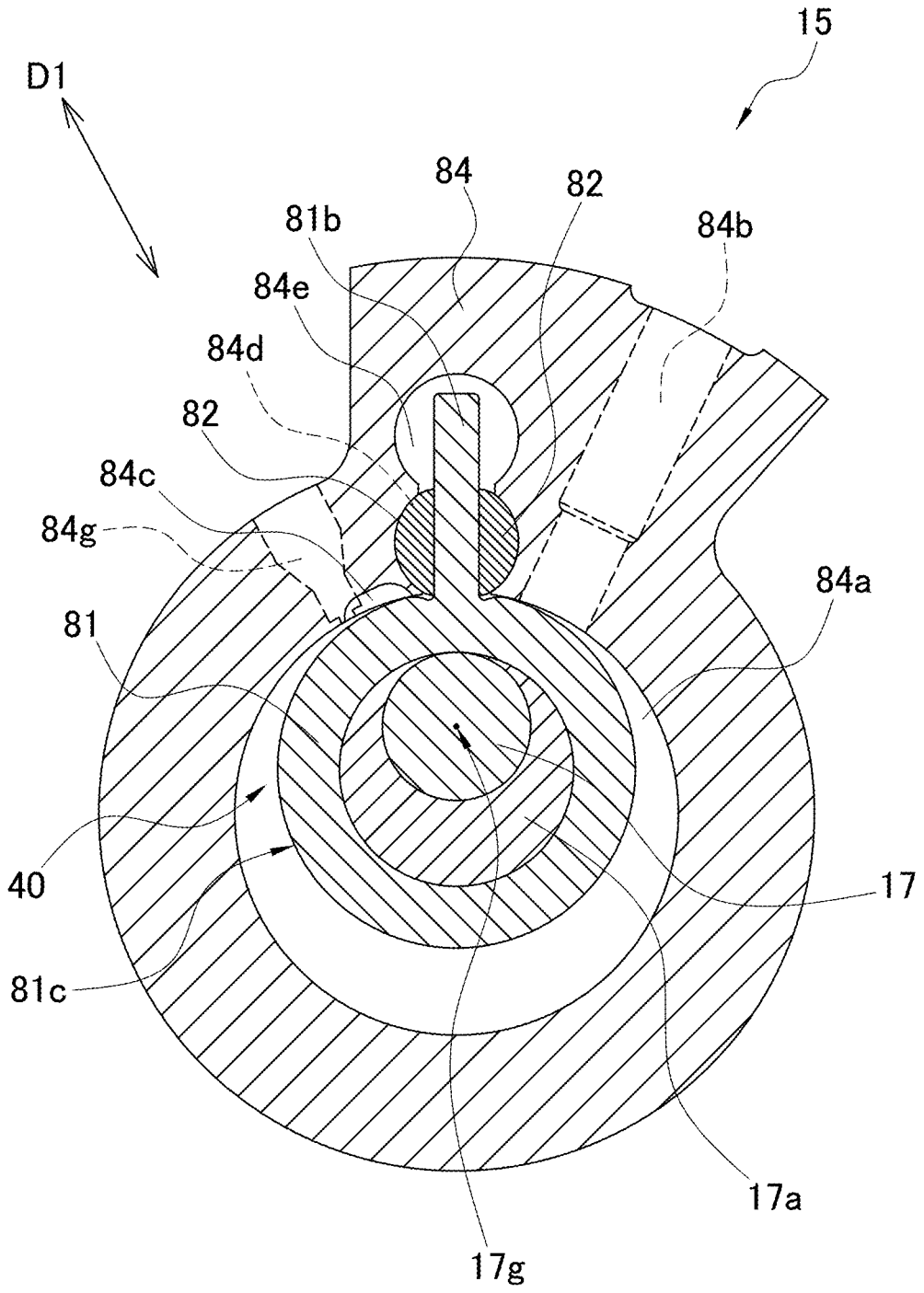
FIG. 10 is a sectional view of the compression mechanism 15 when a piston 81 is located at a top dead center.

As shown in FIG. 10, when the piston 81 is located at the top dead center, the entire vane 81*b* is supported by the pair of bushes 82. At this time, the compression chamber 40 is not defined into the low-pressure chamber 40*a* and the high-pressure chamber 40*b* by the piston 81, and the compression chamber 40 communicates with both the suction hole 84*b* and the injection passage 84*g*. Therefore, the compression chamber 40 is filled with the low-pressure refrigerant flowing from the suction hole 84*b*. Since the pressure in the compression chamber 40 is lower than the intermediate pressure, the intermediate pressure causes the valve body 94 to move toward the valve seat 96 and hit the valve seat 96. As a result, the injection valve 93 is opened, and the intermediate injection is performed (see FIG. 6).

Figure 11:
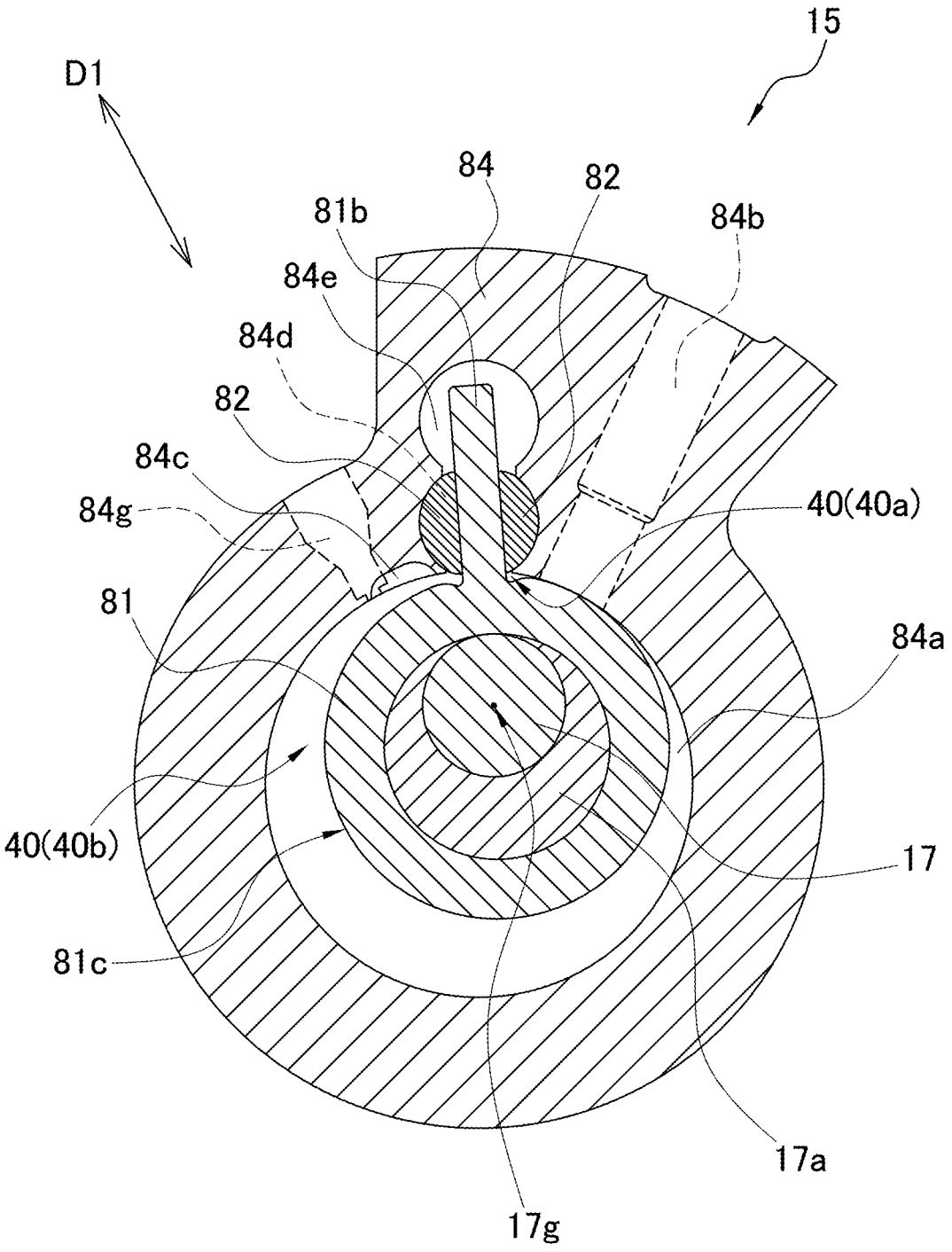
FIG. 11 is a sectional view of the compression mechanism 15 when the piston 81 closes a suction hole 84*b*.

When the piston 81 revolves from the state shown in FIG. 10, the piston 81 closes the opening of the suction hole 84*b* in the cylinder inner peripheral surface 86*c* as shown in FIG. 11. At this time, the compression chamber 40 is defined into the low-pressure chamber 40*a* and the high-pressure chamber 40*b* by the piston 81, and the high-pressure chamber 40*b* communicates with the injection passage 84*g*. Thereafter, when the piston 81 further revolves and the pressure in the high-pressure chamber 40*b* increases, the pressure in the high-pressure chamber 40*b* becomes equal to or higher than the intermediate pressure. Thus, the valve body 94 moves toward the valve presser 95 by the pressure of the high-pressure chamber 40*b* and hits the valve presser 95. As a result, the injection valve 93 is closed, and the intermediate injection ends (see FIG. 5).

The refrigerant in the compression chamber 40 (high-pressure chamber 40*b*) flows into the first space 97 immediately before the end of the intermediate injection. At least a part of the refrigerant flowing into the first space 97 flows into the buffer space 95*c* before passing through the second hole 94*a* of the valve body 94 and reaching the first hole 95*a* as indicated by an arrow in FIG. 7. Accordingly, a time lag is generated between when the refrigerant flows into the first space 97 and when the refrigerant reaches the first hole 95*a*. The valve body 94 hitting the valve seat 96 in the intermediate injection can move toward the valve presser 95 during this time lag to close the first hole 95*a* of the valve presser 95.

As described above, the inner diameter of the opening of the enlarged portion 96*ae* formed in the third hole 96*a* is formed to be larger than the inner diameter of the second hole 94*a* formed in the valve body 94. As a result, since a part of the refrigerant flowing into the third hole 96*a* from the compression chamber 40 hits the periphery of the second hole 94*a*, the valve body 94 can reliably move toward the valve presser 95 and close the first hole 95*a* of the valve presser 95.

Figure 12:
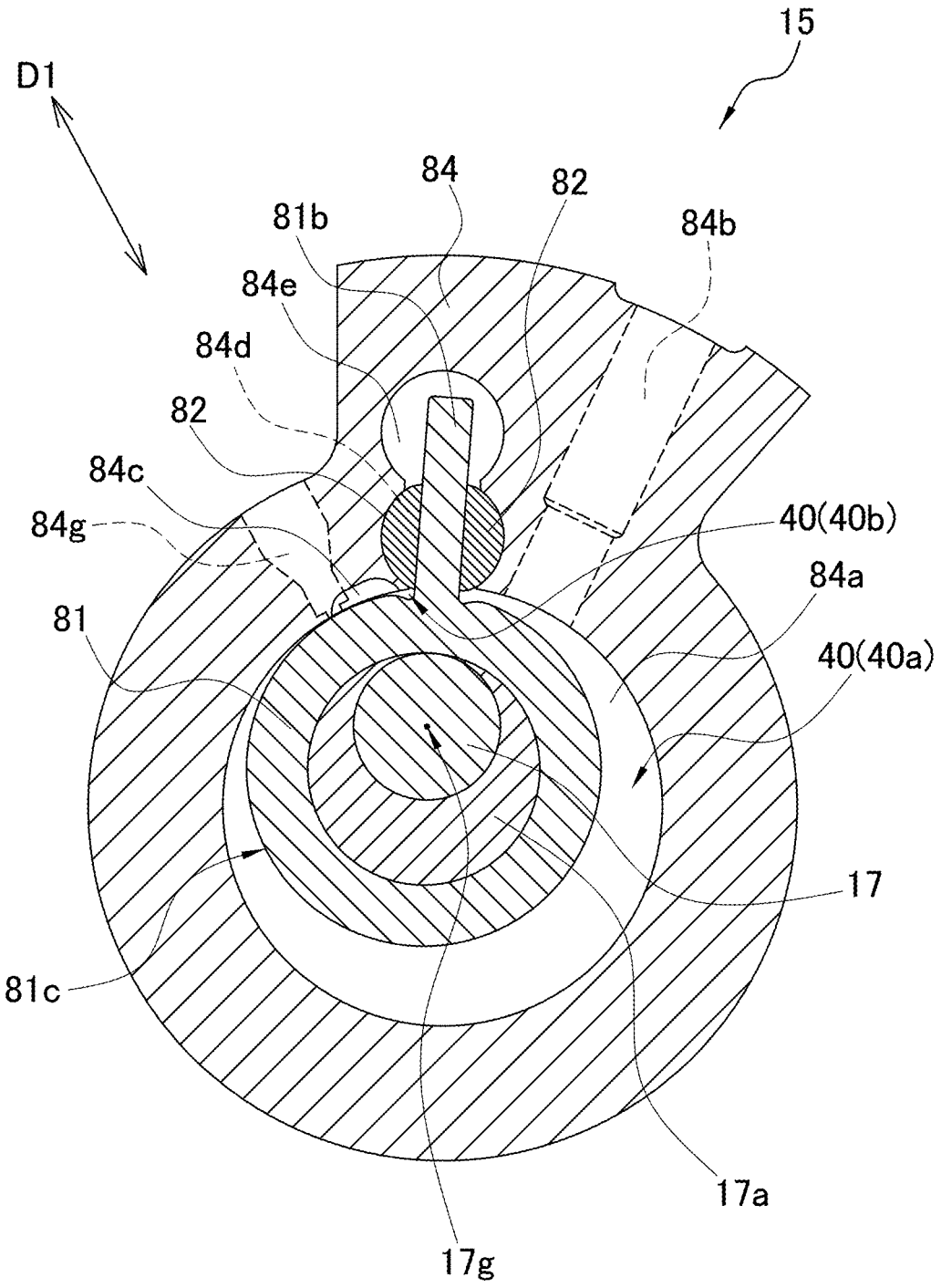
FIG. 12 is a sectional view of the compression mechanism 15 when the piston 81 closes an injection passage 84*g*.

When the piston 81 further revolves, as shown in FIG. 12, the piston 81 closes the opening of the injection passage 84*g* in the cylinder inner peripheral surface 86*c*. At this time, the compression chamber 40 is defined into the low-pressure chamber 40*a* and the high-pressure chamber 40*b* by the piston 81, and the low-pressure chamber 40*a* communicates with the suction hole 84*b*. Therefore, the low-pressure chamber 40*a* is filled with the low-pressure refrigerant flowing from the suction hole 84*b*. Thereafter, when the piston 81 further revolves and the low-pressure chamber 40*a* communicates with the injection passage 84*g*, due to the pressure of the low-pressure chamber 40*a*, which is lower than the intermediate pressure, the valve body 94 moves toward the valve seat 96 by the intermediate pressure and hits the valve seat 96. As a result, the injection valve 93 is opened, and the intermediate injection is performed (see FIG. 6). Thereafter, when the piston 81 further revolves, the piston 81 is located at the top dead center as shown in FIG. 10.

As described above, while the piston 81 is revolving, the injection valve 93 is opened and closed by the pressure difference between the refrigerant in the compression chamber 40 and the refrigerant having an intermediate pressure in the injection pipe 92. As a result, when the pressure in the compression chamber 40 is lower than the intermediate pressure in the injection pipe 92, the injection valve 93 is opened, and the intermediate injection is performed. When the pressure in the compression chamber 40 is equal to or higher than the intermediate pressure, the injection valve 93 is closed, and the intermediate injection is not performed.

In this manner, the injection valve 93 can perform the intermediate injection and suppress the refrigerant from flowing out of the compression chamber 40 into the injection passage 84*g* when the intermediate injection is not performed. Therefore, since a sufficient amount of the refrigerant having an intermediate pressure is supplied to the compression chamber 40 while the compressor 21 is operating, the compressor 21 can obtain a higher compression rate than in a case where the injection valve 93 is not provided.

(3) Characteristics (3-1)

The compressor 21 includes the compression mechanism 15, the injection valve 93, and the injection pipe 92. The compression mechanism 15 includes the compression chamber 40 in which the refrigerant is compressed. The injection valve 93 is disposed in the injection passage 84*g* that communicates with the compression chamber 40. The injection pipe 92 allows the refrigerant to be supplied to the injection passage 84*g*.

The injection valve 93 includes the valve body 94, the valve presser 95, and the valve seat 96. The valve body 94 is disposed so as to be movable along the first direction D1. The valve presser 95 is disposed closer to the injection pipe 92 than the valve body 94, and restricts the movement of the valve body 94 toward the injection pipe 92. The valve seat 96 is disposed closer to the compression chamber 40 than the valve body 94, and restricts the movement of the valve body 94 toward the compression chamber 40. The valve presser 95 has the first hole 95*a* that is closed by the valve body 94 when the refrigerant passes and flows out of the compression chamber 40. The valve body 94 has the second hole 94*a* through which the refrigerant passes.

The compressor 21 has the buffer space 95*c* that communicates with the first space 97 in which the valve body 94 is accommodated between the valve presser 95 and the valve seat 96, and into which the refrigerant flowing from the compression chamber 40 into the first space 97 flows before reaching the first hole 95*a*.

As in the compressor 21, the injection valve 93 that moves the plate-shaped valve body 94 using the pressure difference between the compression chamber 40 and the injection passage 84*g* has a simpler structure than a check valve that moves the valve body 94 with a spring member. On the other hand, depending on the weight and the shape, the valve body 94 does not move quickly in the first space 97, and the high-pressure refrigerant flows out from the compression chamber 40 to the injection passage 84*g* immediately before the intermediate injection ends, and there is a possibility that a high compression rate cannot be achieved.

In the compressor 21, at least a part of the refrigerant flowing into the first space 97 immediately before the end of the intermediate injection flows into the buffer space 95*c* before reaching the first hole 95*a*. Accordingly, a time lag is generated between when the refrigerant flows into the first space 97 and when the refrigerant reaches the first hole 95*a*. The valve body 94 hitting the valve seat 96 in the intermediate injection can move toward the valve presser 95 during this time lag to close the first hole 95*a* of the valve presser 95 and suppress the outflow of the refrigerant from the compression chamber 40 to the injection passage 84*g*.

As described above, the compressor 21 has a simple structure in which the injection valve 93 does not use a spring member, and can still obtain a high compression efficiency by suppressing the outflow of the refrigerant from the compression chamber 40 to the injection passage 84*g* immediately before the end of the intermediate injection.

(3-2)

The buffer space 95*c* is formed closer to the injection pipe 92 than the second hole 94*a*.

(3-3)

The buffer space 95*c* is a concave portion formed on a surface of the valve presser 95 facing the valve body 94.

(3-4)

The first space 97 has a cylindrical shape. The valve body 94 is a circular flat plate having a second hole 94*a* at the center. The buffer space 95*c* is located on the center axis CL of the first space 97 together with the second hole 94*a*.

As a result, since the buffer space 95*c* and the second hole 94*a* are located on the center axis CL, most of the refrigerant passing through the second hole 94*a* can flow into the buffer space 95*c*, and the outflow of the refrigerant from the compression chamber 40 is effectively suppressed.

(3-5)

The ratio of the area of the opening 95*co* of the buffer space 95*c* facing the valve body 94 to the flow path area of the second hole 94*a* is 0.5 or more and 1.0 or less.

As a result, since most of the refrigerant passing through the second hole 94*a* can flow into the buffer space 95*c*, the outflow of the refrigerant from the compression chamber 40 is effectively suppressed.

(3-6)

The ratio between the depth d of the buffer space 95*c* in the first direction D1 of the first space 97 and the length L of the first hole 95*a* in the first direction D1 is 0.3 or more and 0.6 or less.

As a result, since most of the refrigerant passing through the second hole 94*a* can flow into the buffer space 95*c*, a time lag from when the refrigerant flows into the first space 97 to when the refrigerant reaches the first hole 95*a* is reliably generated, and the outflow of the refrigerant from the compression chamber 40 is effectively suppressed.

(3-7)

The valve seat 96 has the third hole 96*a* that allows the first space 97 and the compression chamber 40 to communicate with each other. The ratio of the volume of the buffer space 95*c* to the total volume of the first space 97 and the third hole 96*a* is 0.2 or more and 0.8 or less.

As a result, since most of the refrigerant flowing into the first space 97 can flow into the buffer space 95*c*, a time lag from when the refrigerant flows into the first space 97 to when the refrigerant reaches the first hole 95*a* is reliably generated, and the outflow of the refrigerant from the compression chamber 40 is effectively suppressed.

(3-8)

The air conditioner 1 includes the compressor 21.

The air conditioner 1 including the compressor 21 having a high compression efficiency can perform an air conditioning operation with high efficiency.

(4) Modification

The injection valve 93 can also be applied to a compressor other than the rotary compressor. For example, the injection valve 93 can also be applied to a scroll compressor.

The embodiment of the present disclosure has been described above. Various modifications to modes and details should be available without departing from the gist and the scope of the present disclosure recited in the claims.

The invention claimed is:

1. A compressor comprising:

a compression mechanism including a piston and a cylinder, the piston and the cylinder defining a compression chamber in which a refrigerant is compressed;

an injection valve disposed in an injection passage that communicates with the compression chamber; and an injection pipe that allows the refrigerant to be supplied to the injection passage, the injection valve including a valve body disposed to be movable along a first direction, a valve presser that is disposed closer to the injection pipe than the valve body and restricts movement of the valve body toward the injection pipe, and a valve seat that is disposed closer to the compression chamber than the valve body and restricts movement of the valve body toward the compression chamber, the valve presser having a first hole through which the refrigerant passes, the valve body having a second hole through which the refrigerant passes, a buffer space being formed that communicates with a first space and into which the refrigerant flowing from the compression chamber into the first space flows, the first space accommodating the valve body between the valve presser and the valve seat, and the buffer space having an opening facing the valve body, the opening not overlapping an annular peripheral edge located around the second hole of the valve body when viewed in the first direction, a ratio of a depth of the buffer space in the first direction of the first space to a length of the first hole in the first direction being 0.3 to 0.6, the valve seat including a third hole that allows the first space and the compression chamber to communicate with each other, and a ratio of a volume of the buffer space to a total volume of the first space and the third hole being 0.2 to 0.8.

2. The compressor according to claim 1, wherein the buffer space is formed closer to the injection pipe than the second hole.

3. The compressor according to claim 1, wherein the buffer space is a concave portion formed on a surface of the valve presser, the surface facing the valve body.

4. The compressor according to claim 1, wherein the first space has a cylindrical shape, the valve body is a circular flat plate having the second hole at a center, and the buffer space is located on a center axis of the first space together with the second hole.

5. The compressor according to claim 1, wherein a ratio of an area of an opening of the buffer space facing the valve body to a flow path area of the second hole is 0.5 to 1.0.

6. An air conditioner including the compressor according to claim 1.

7. A compressor comprising:

a compression mechanism including a piston and a cylinder, the piston and the cylinder defining a compression chamber in which a refrigerant is compressed;

an injection valve disposed in an injection passage that communicates with the compression chamber; and an injection pipe that allows the refrigerant to be supplied to the injection passage, the injection valve including a valve body disposed to be movable along a first direction, a valve presser that is disposed closer to the injection pipe than the valve body and restricts movement of the valve body toward the injection pipe, and a valve seat that is disposed closer to the compression chamber than the valve body and restricts movement of the valve body toward the compression chamber, the valve presser having a first hole through which the refrigerant passes and that is closed by the valve body when the refrigerant flows out of the compression chamber, the valve body having a second hole through which the refrigerant passes, a buffer space being formed that communicates with a first space and into which the refrigerant flowing from the compression chamber into the first space flows before reaching the first hole, the first space accommodating the valve body between the valve presser and the valve seat, and the buffer space having an opening facing the valve body, the opening not overlapping an annular peripheral edge located around the second hole of the valve body when viewed in the first direction, a ratio of a depth of the buffer space in the first direction of the first space to a length of the first hole in the first direction being 0.3 to 0.6 the valve seat including a third hole that allows the first space and the compression chamber to communicate with each other, and a ratio of a volume of the buffer space to a total volume of the first space and the third hole being 0.2 to 0.8.

8. The compressor according to claim 7, wherein the buffer space is formed closer to the injection pipe than the second hole.

9. The compressor according to claim 7, wherein the buffer space is a concave portion formed on a surface of the valve presser, the surface facing the valve body.

10. The compressor according to claim 7, wherein the first space has a cylindrical shape, the valve body is a circular flat plate having the second hole at a center, and the buffer space is located on a center axis of the first space together with the second hole.

11. The compressor according to claim 7, wherein a ratio of an area of an opening of the buffer space facing the valve body to a flow path area of the second hole is 0.5 to 1.0.

12. An air conditioner including the compressor according to claim 7.

13. A compressor comprising:

a compression chamber in which a refrigerant is compressed; and a valve disposed in an injection passage that communicates with the compression chamber, the valve including a valve body that is accommodated in a first space and has a second hole, a valve presser that has a first hole communicating with the first space and defines the first space, and a valve seat that has a third hole communicating with the first space and defines the first space, the valve presser having a concave portion that is a buffer space, the buffer space having an opening on a surface of the valve presser facing the first space, and the opening not overlapping an annular peripheral edge located around the second hole of the valve body when viewed in a first direction in which the injection passage extends, a ratio of a depth of the buffer space in the first direction of the first space to a length of the first hole in the first direction being 0.3 to 0.6 the valve seat including a third hole that allows the first space and the compression chamber to communicate with each other, and a ratio of a volume of the buffer space to a total volume of the first space and the third hole being 0.2 to 0.8.

14. The compressor according to claim 13, wherein the valve body is a circular flat plate having the second hole, the first space has a cylindrical shape, and the concave portion is located on a center axis of the first space together with the second hole.

15. The compressor according to claim 13, wherein the buffer space is a space into which a refrigerant flowing into the first space flows.

* * * * *